United States Patent [19]

Schuellein

[11] Patent Number: 5,021,769

[45] Date of Patent: Jun. 4, 1991

[54] ICE DETECTOR FOR PROTECTING BOATS

[76] Inventor: George J. Schuellein, 2554 Southand Ave., Oceanside, N.Y. 11572

[21] Appl. No.: 515,611

[22] Filed: Apr. 27, 1990

[51] Int. Cl.[5] ..... G08B 21/00

[52] U.S. Cl. ..... 340/580; 340/984

[58] Field of Search ..... 340/580, 984

[56] References Cited

U.S. PATENT DOCUMENTS 2,901,741 8/1959 Moore et al. ..... 340/580

4,873,510 10/1989 Khurgin ..... 340/580

*Primary Examiner*—Glen R. Swann, III

*Attorney, Agent, or Firm*—James P. Malone

[57] ABSTRACT

Ice Detector for Protecting Boats has a waterproof hollow float. An electro-magnet is mounted in the float. A flexible arm is rigidly mounted on one side of said float. A first metal segment is mounted in the arm and placed to be attracted by the magnet. A metal detector is mounted in the float. A second metal segment is mounted in the arm and placed to come into closer proximity to the detector when the arm flexes, whereby, ice forming between the wall of the float and the arm will prevent movement of the arm and will detect the formation of ice.

2 Claims, 4 Drawing Sheets

ICE DETECTOR FOR PROTECTING BOATS

This invention relates to ice detectors for protecting boats from ice damage.

BACKGROUND

The purpose of the device, named "Ice Detector" is to sense the formation of ice on the surface of a body of water, and to place into operation whatever type of ice destruction system has been provided for that purpose. The principal benefit of the Ice Detector versus other means of turning on and off ice destruction systems is the protection of boats, docks, pilings and piers from damage from winter surface ice formation, while minimizing the wastage of electrical energy by operating ice destruction systems only when surface ice is actually forming. Other devices currently in use for this purpose, such as air thermostats, aquastats and timers, are ineffective to that end in that none of the variables monitored are directly related to the actual formation of ice on the water surface.

THE INVENTION

This Ice Detector device consists of two parts; a waterproof detector float which contains the sensing system and which floats upon the surface of the water, and an electronic control module which is placed on the boat, dock or float to be protected. The sensing float and the control module are connected with a four wire cable, which also serves to maintain the sensor float in close proximity to the object to be protected.

OBJECTS OF THE INVENTION

A principal object of the invention is to provide new and improved means for detecting ice for protecting boats, etc. from ice damage.

Another object of the invention is to provide new and improved means for detecting ice for protecting boats from ice damage having a magnetic circuit, which is adapted to detect formation of ice.

Another object of the invention is to provide a new and improved ice detector for protecting boats, comprising; a waterproof hollow float, an electro-magnet mounted in the float, a flexible arm, mounted on one side of said float, a first metal segment imbedded in said arm and placed to be attracted to the magnet, a metal detector mounted in said float, a second metal segment imbedded in said arm and placed to actuate said detector; whereby, ice forming between the wall of the float and said arm will prevent movement of the arm when attracted by the magnet and will not actuate the detector.

DESCRIPTION OF THE PREFERRED EMBODIMENT

Figure 1:
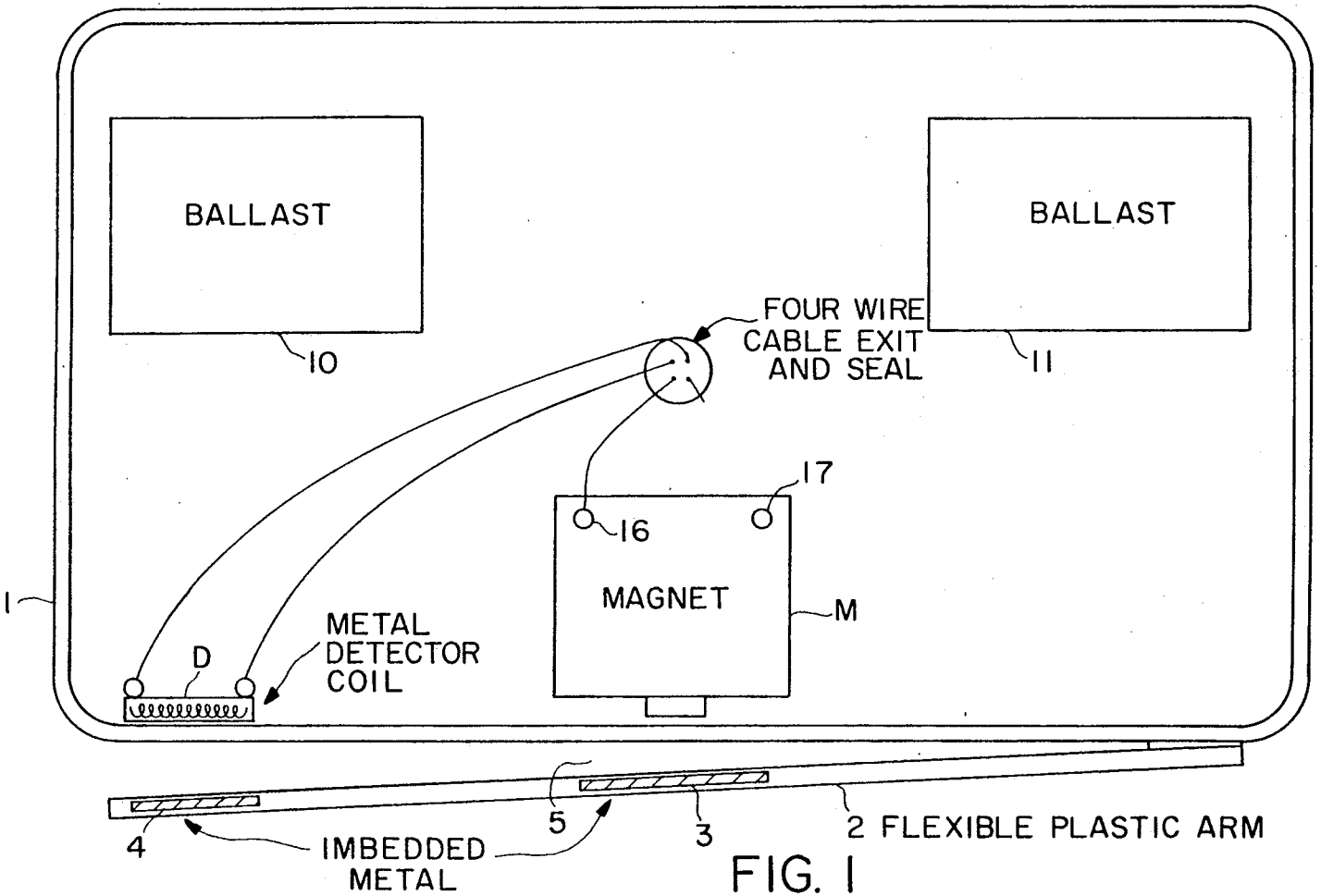
FIG. 1 is a top view of an embodiment of the invention with the cover removed.
Figure 2:
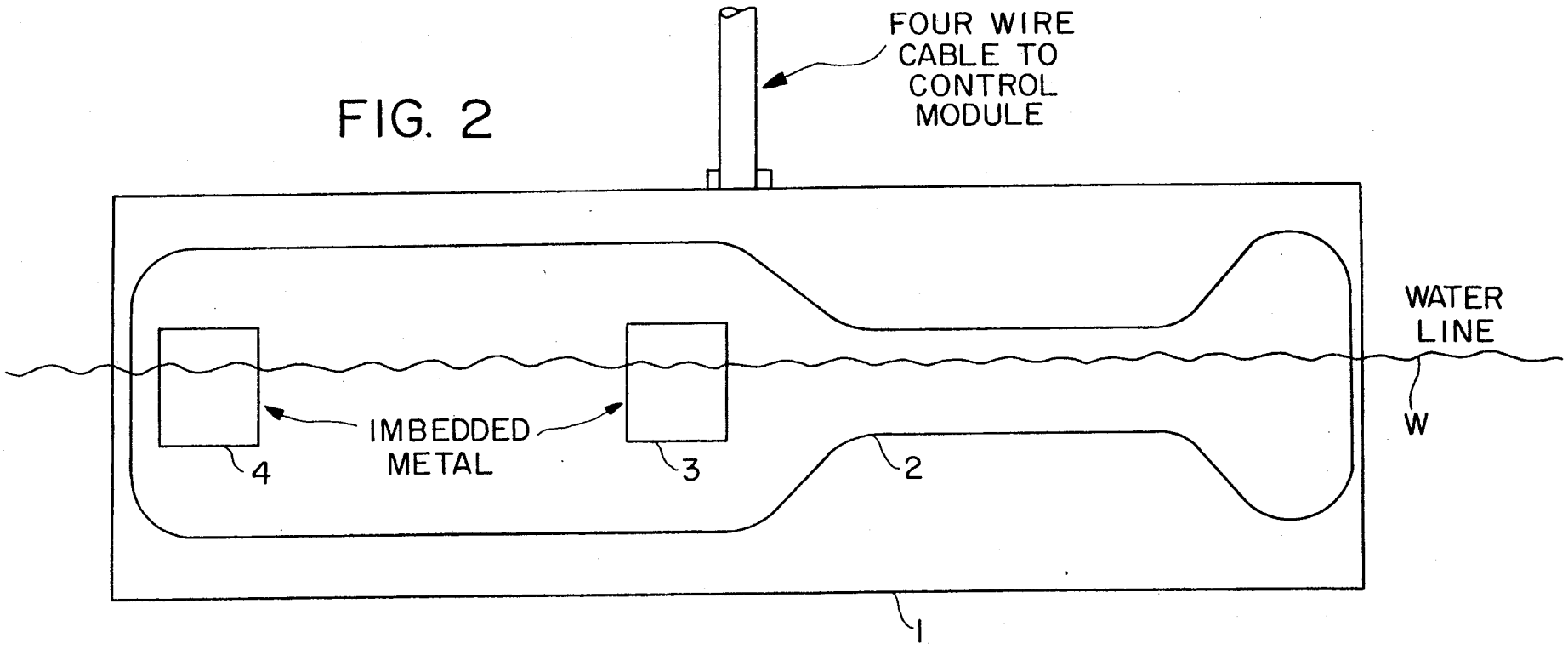
FIG. 2 is a side view of the embodiment of FIG. 1.

Referring to the figures, FIG. 1 shows a plan view of an embodiment of the invention, and FIG. 2 shows a side view of FIG. 1.

The hollow float 1 is adapted to float in the water alongside the boat to be protected. The hollow float 1 contains a magnet M. A flexible plastic arm 2 is rigidly mounted on the side of the float 1. The arm 2 has a first metal segment 3, which is adapted to be attracted to the magnet M when the magnet is energized.

The arm 2 has a second metal segment 4, which is placed to activate the metal detector D when brought into closer proximity to it by the flexing of the arm by the magnets's attraction.

When the magnet is energized, if there is no ice present, then the metal piece 4 comes into closer proximity to the detector D. However, if there is ice between the wall of the float 1 and the arm 2 the magnet M. while not attracting the metal piece 3, will not be able to flex the arm 2 so that a signal will be provided to start deicing equipment.

FIG. 1 also shows two ballast blocks 10 and 11, which are placed to hold the float 1 to the proper relation to the water line W, FIG. 2.

Figure 3:
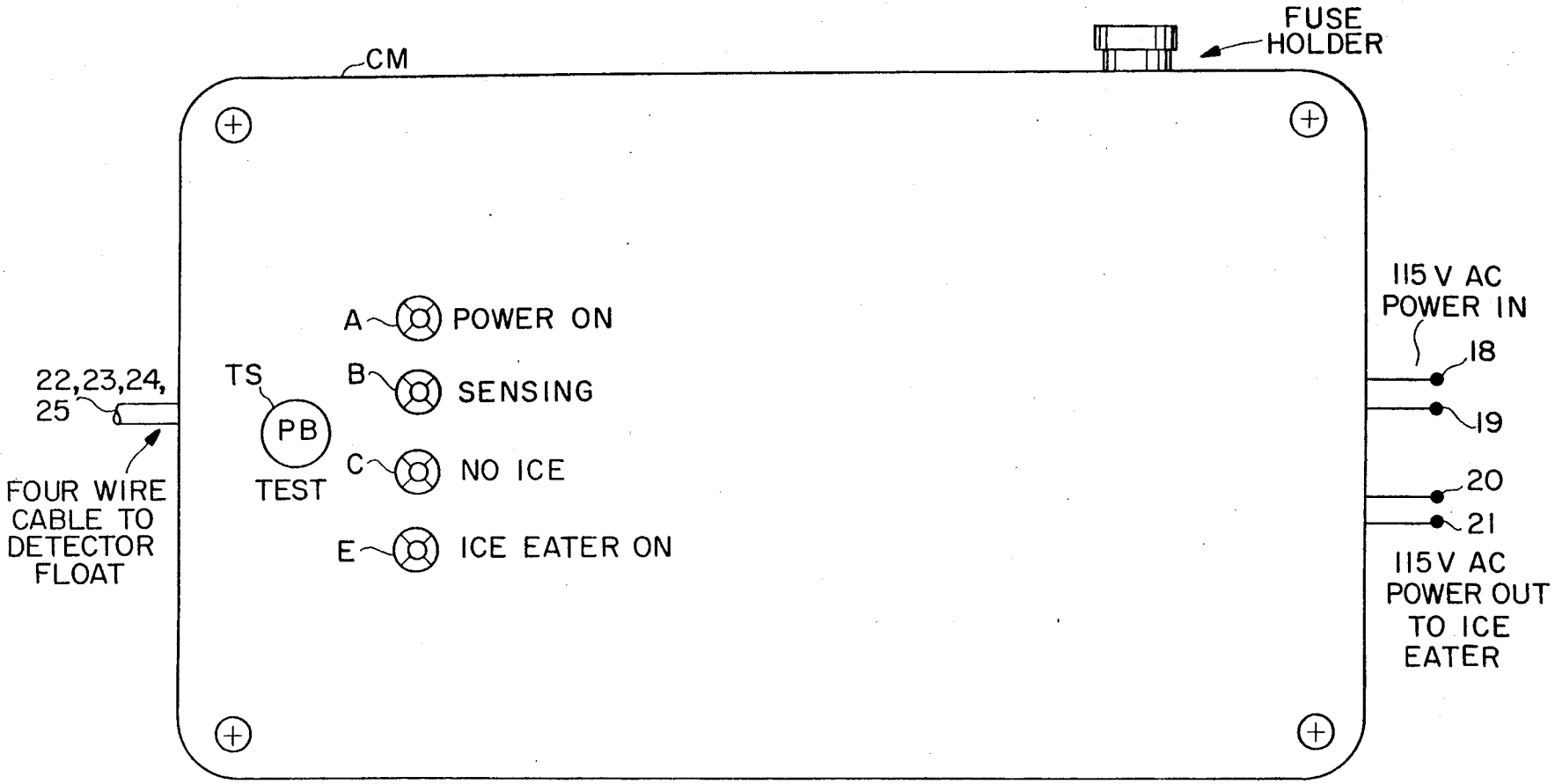
FIG. 3 is a top view of the control module panel.

FIG. 3 shows the panel of the control module CM, which is located on the dock where the boat is tied up, or on the boat. Terminals 18 and 19 on the panel module are connected to a source of 115v AC on the dock or boat.

Terminals 20 and 21 are connected to suitable "Ice Eater" apparatus, which melts ice that has formed. These devices eliminate the ice around the hull of the boat by moving the water, either by bubbling with compressed air or with a propeller drive which is set to bring up warmer water from below to melt ice that has formed around the hull of the boat.

Figure 4:
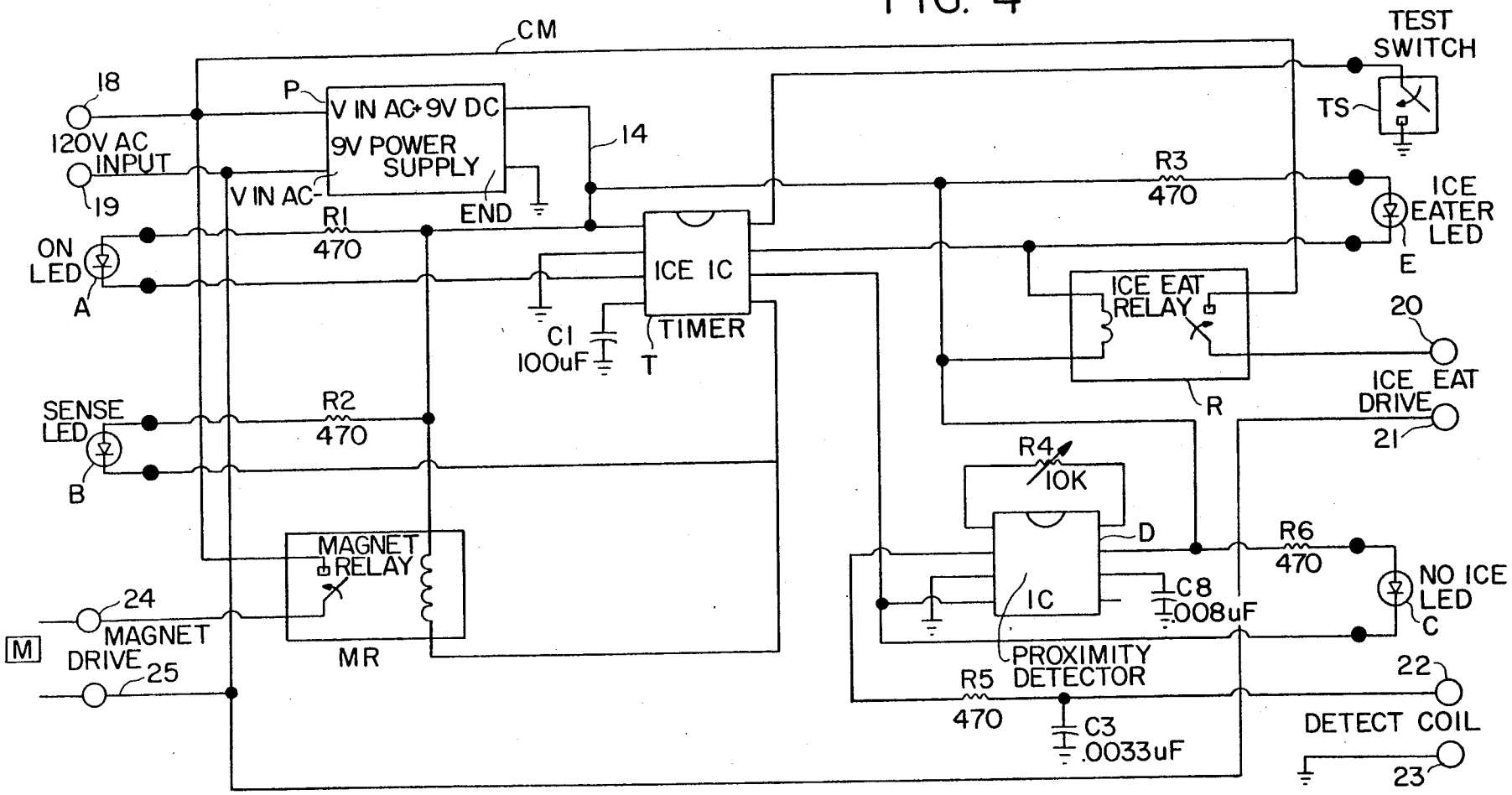
FIG. 4 is a schematic block diagram of the circuit of the invention.

Terminals 22 and 23, FIG. 4, are connected to the detector circuit in the float 1. The module panel also shows power on indicator light A, sensing light B, "no ice" light C, and "Ice Eater" (Ice Remover On)E. Terminals 24, 25, are connected to the magnet.

The "Ice Eater" may be a conventional bubble system or equivalent.

FIG. 4 shows a schematic block diagram of the circuitry which is contained in the control module. CM.

Power supply P is connected to a source 115–120v AC by terminals 18 and 19. The power supply provides 9v DC to the other components.

The timer T is used for alternate periodic operation. The detector D operates to detect the presence of ice. The module also has the four indicator lights previously mentioned. A, B C and D.

Other equivalent conventional circuits may be used.

OPERATION

At intervals of between 9 and 15 minutes the sensing phase of a cycle is activated by timer T for a period of 3 to 8 seconds during which time the following occurs:

1. The magnet within the sensing float is energized and attempts to attract an iron containing piece of metal encased in the plastic flexible arm, which is attached to the sensing float at one end.

2. If no surface ice is present, the plastic arm deflects under the magnetic pull, bringing a second piece of metal encased in the opposite end of the flexible plastic arm in closer proximity to a metal detector coil located within the sensing float.

3. Upon the detection of the approach of the metal, the electronic circuitry is such that a "no ice" signals is generated and the ice destruction system is not energized or, if it had been energized, it is deenergized.

4. If, however, surface ice is present, the plastic arm will not deflect since the magnetic pull is insufficient to overcome the strength of the ice in compression and the metal in the plastic arm will not approach the metal detector coil. The electronic circuitry is such that under this condition an "Ice Present"$\pi$signal is generated and the ice destruction system is energized or, if already energized, will continue to be energized.

Magnetic relay MR is connected to energize magnet M.

"Ice Eat" relay R will operate associated ice dissipating apparatus.

Detector D operates "Ice Eat" relay R.

The sensing float is waterproof and corrosion proof since no metal, only plastic, is in contact with the water. The control module, while water resistant, must be protected from the elements by appropriate placement.

The control module, which contains a 9 volt power supply and other electronic components, is equipped with indicator lights and a test push button for monitoring the operation and testing of the unit. Indicator lights (LED's) are provided for: a) power on, B) sensing, C) no ice, D) ice eater on. The test push button, TS when activated, energizes the magnet. An "Ice Present" condition can be simulated by placing an object between the flexible plastic arm and the float to prevent deflection when the magnet is energized.

The Ice Detector operates from a 115 volt AC outlet and a three wire male plug and power cord is provided. The control module provides a three wire 115 volt AC outlet for plug in of an Ice Eater or other ice destruction device which draws no more than 9 amperes continuous. For more powerful ice destruction systems, such as large air compressors servicing extensive air bubbler systems, power relaying is required.

Malfunctions may occur if floating debris lodges between the float and the flexible plastic arm. The device can be classified "fail safe" under this condition since the ice destruction system will be placed in operation and resulting turbulence may very well dislodge the interferring object. If debris is not so dislodged, operator intervention will be required to restore the device to normal operation.

I claim:

1. Ice Detector for Protecting Boats, Docks, Piers and Pilings, comprising;

a water proof hollow float, an electro-magnet mounted in the float, a flexible arm rigidly mounted on one side of said float, a first metal segment mounted in said arm and adapted to be attracted by the magnet, a metal detector mounted in said float, a second metal segment mounted in said arm and adapted to come into closer operative proximity with said detector, whereby ice forming between the wall of the float and the arm will prevent deflection of the arm and will detect the formation of ice.

2. Ice detector for protecting boats, Docks, Piers and Pilings, comprising;

a waterproof hollow float, a flexible arm rigidly mounted on one side of said float, means to urge said flexible arm toward said float, a detector mounted in said float to detect movement of said arm toward said float, whereby ice forming between the wall of the float and the arm will be detected by the failure of said detector to detect movement of said arm toward said float when it is so urged.

* * * * *